US008517808B2

(12) United States Patent
Chang et al.

(10) Patent No.: US 8,517,808 B2
(45) Date of Patent: Aug. 27, 2013

(54) COIN HOPPER WITH AN UPWARD COIN PASSAGE

(75) Inventors: Chiao-Hao Chang, Taipei (TW); Tzu-Feng Tseng, Taipei (TW); Sung-Ching Lin, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 0 days.

(21) Appl. No.: 13/407,586

(22) Filed: Feb. 28, 2012

(65) Prior Publication Data

US 2012/0156977 A1 Jun. 21, 2012

Related U.S. Application Data

(63) Continuation-in-part of application No. 12/709,210, filed on Feb. 19, 2010, now abandoned.

(30) Foreign Application Priority Data

Nov. 18, 2009 (TW) ..... 98139161 A

(51) Int. Cl.
*G07D 1/00* (2006.01)

(52) U.S. Cl.
USPC ..... 453/57

(58) Field of Classification Search
USPC ..... 453/57, 18, 29, 34, 35, 36, 44, 49; 221/251, 254; 193/DIG. 1
See application file for complete search history.

(56) References Cited

U.S. PATENT DOCUMENTS

| | | | | |
|---|---|---|---|---|
| 4,592,377 | A | 6/1986 | Paulsen et al. | |
| 5,688,166 | A | 11/1997 | Chen | |
| 7,018,285 | B2 | 3/2006 | Enomoto | |
| 7,201,649 | B2 * | 4/2007 | Abe | 453/29 |

* cited by examiner

*Primary Examiner* — Mark Beauchaine
(74) *Attorney, Agent, or Firm* — Muncy, Geissler, Olds & Lowe, PLLC

(57) ABSTRACT

A coin hopper includes a coin pusher consisting of a container, a rotating disc and a power drive for dispensing coins, and a rack that defines therein a coin passage that extends upwardly from the coin pusher and consists of a bottom sloping segment, an intermediate arched segment and a top vertical segment for guiding out coins one by one and has floating rods transversely arranged therein to prohibit dispensed coins from backward displacement and to avoid coin stacking, track parts damage or motor overload.

9 Claims, 9 Drawing Sheets

COIN HOPPER WITH AN UPWARD COIN PASSAGE

This application is a Continuation-In-Part of application Ser. No. 12/709,210, filed on Feb. 19, 2010, now abandoned, for which priority is claimed under 35 U.S.C. §120. The patent application identified above is incorporated here by reference in its entirety to provide continuity of disclosure. This application also claims priority of Application No. 098139161 filed in Taiwan, R.O.C. on Nov. 18, 2009, under 35 U.S.C. §119.

BACKGROUND OF THE INVENTION

1. Field of the Invention

The present invention relates to coin dispensing technology and more particularly, to a coin hopper with an upward coin passage, which comprises a coin pusher consisting of a container, a rotating disc and a power drive for dispensing coins, and a track that defines therein a coin passage that extends upwardly from the coin pusher and consists of a bottom sloping segment, an intermediate arched segment and a top vertical segment for guiding out coins one by one and has floating rods transversely arranged in the intermediate arched segment to prohibit dispensed coins from backward displacement and to avoid coin stacking, track parts damage or motor overload.

2. Description of the Related Art

A coin hopper is designed for use in a coin exchange machine, gambling machine, amusement machine or vending machine for sending out or issuing coins or tokens one by one. However, coins or tokens of different thicknesses, sizes and/or shapes may be used in different countries or different machines.

A conventional coin hopper is known using a motor to rotate a rotating disc for dispensing coins/tokens. The rotating disc has a plurality of equiangularly spaced pins. A guide member and a micro switch are respectively mounted in the inner side and outer side of the coin outlet of the coin hopper. During rotation of the rotating disc, coins/tokens are pushed one by one by the pins of the rotating disc toward the coin outlet and then guided out of the coin outlet by the guide member. When one coin/token passes through the coin outlet, it will touch the micro switch, achieving count of the dispensed coin/token. Further, because the total weight of the coins/tokens that are accommodated in the container of the coin hopper is heavy and for the sake of lowering the gravity center to assure machine stability during transportation, the container is set at the bottom side and a conveying means or track means is provided between the rotating disc and the coin outlet to guide each dispensed coin/token to the coin outlet that is disposed at a relatively higher place. Thus, the user can pick up each dispensed coin when sitting or standing in front of the machine.

FIG. 9 illustrates a track for coin hopper according to the prior art design. As illustrated, the track A comprises a bottom plate A1, two rails A2 bilaterally arranged at the top side of the bottom plate A1, a coin passage A3 defined between the two rails A2 above the bottom plate A1, a locating plate A4 transversely affixed to the two rails A2 above the coin passage A3 by fastening members A41 and a plurality of leaf springs A5 arranged in a stack and affixed to the locating plate A4 in such a manner that the arched press portions A51 of the leaf springs A5 are arranged in line and suspending in the coin passage A3. When the rotating disc of the coin hopper is rotated by the motor through the transmission mechanism to dispense coins/tokens into the coin passage A3 of the track A one by one, the arched press portions A51 of the leaf springs A5 are pressed on the dispensed coins/tokens B, preventing stacking of the coins/tokens B. This structure of coin hopper is functional, however due to the effect of the holding down pressure from the arched press portions A51 of the leaf springs A5, the rotating disc receives a great resistance during its rotation. In order to overcome this great resistance, the output power of the motor must be relatively increased. However, increasing the capacity of the motor relatively increases the cost. Further, due to strong resistance from the leaf springs A5, a heavy vibration is produced during operation of the motor to rotate the rotating disc at a high speed. In consequence, the component parts of the transmission mechanism and the motor may wear quickly with use or may be damaged easily during operation.

Therefore, it is desirable to provide a coin hopper that eliminates the aforesaid problem.

SUMMARY OF THE INVENTION

The present invention has been accomplished under the circumstances in view. It is therefore the main object of the present invention to provide a coin hopper, which is practical for dispensing coins/tokens of different shapes, sizes and thickness without changing any components. It is still another object of the present invention to provide a coin hopper, which dispenses coins/tokens smoothly, avoiding track parts damage or motor overload.

To achieve these and other objects of the present invention, a coin hopper comprises a coin pusher and a track. The coin pusher comprises a container having a bottom opening, a coin outlet, a rotating disc mounted in the container and a power drive adapted for rotating the rotating disc to dispense coins out of the bottom opening of the container through the coin outlet. The track is connected to the coin pusher, comprising a coin passage, a bottom plate disposed at the bottom side of the coin passage, a cover plate disposed at the top side of the coin passage, two side rails disposed at two opposite lateral sides of the coin passage and sandwiched between the bottom plate and the cover plate, and non-return means arranged in the coin passage to restrict the movement of coins in one direction. The coin passage comprises a bottom sloping segment connected to the coin outlet, a top vertical segment, and an intermediate arched segment connected between the bottom sloping segment and the top vertical segment. The design of the intermediate arched segment enables each coin to be moved smoothly upwards with less friction resistance.

Further, the non-return means comprises a plurality of floating spaces arranged in series in the coin passage corresponding to the intermediate arched segment, and a floating rod floating in each floating space. Each floating space comprises two first constraint grooves respectively located on the two side rails, and a second constraint groove located on the cover plate corresponding to the first constraint grooves. The first constraint grooves and the second constraint groove each have a bearing surface. The floating space has a depth, which is the distance between the bearing surface of the second constraint groove and a top surface of the bottom plate and reduces gradually in direction away from the coin passage.

The design of the non-return means allows coins to push the floating rods upwards in the associating constraint grooves so that coins can be moved upwards along the intermediate arched segment of the coin passage smoothly at a predetermined tilting angle with less friction. Thus, the motor can rotate the rotating disc to dispense coins smoothly. Therefore, it is not necessary to upgrade the capacity of the motor or to enhance the structural strength of the track, saving the cost.

Further, because the bottom plate of the track is configured subject to curvature of the bottom sloping segment, intermediate arched segment and top vertical segment of the coin passage, the friction resistance between the coins in the coin passage and the bottom plate is minimized. Therefore, the dispensed coins can be quickly moved to the top vertical segment of the coin passage one by one in a proper order and prohibited from backward movement or stacking, avoiding component damage or motor overload.

DETAILED DESCRIPTION OF THE PREFERRED EMBODIMENT

Figure 1:
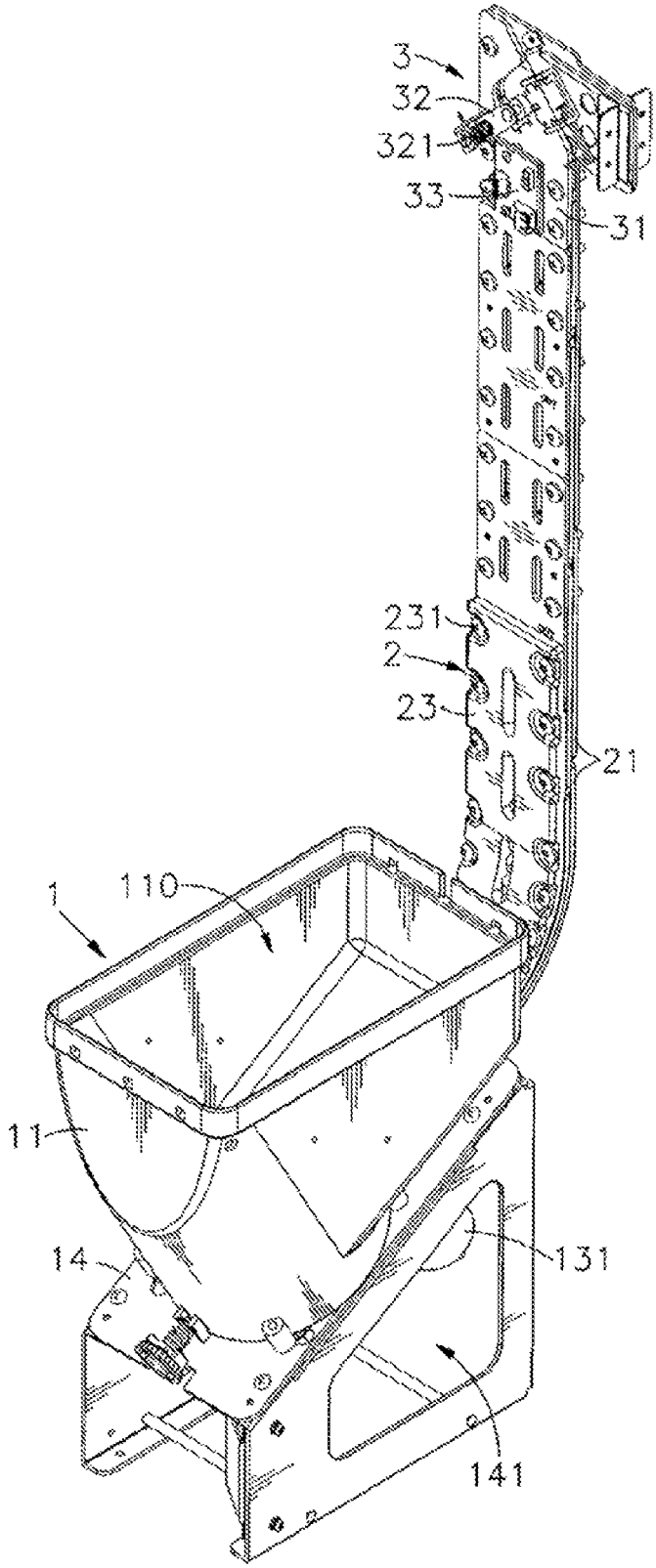
FIG. 1 is an elevational view of a coin hopper in accordance with the present invention.
Figure 2:
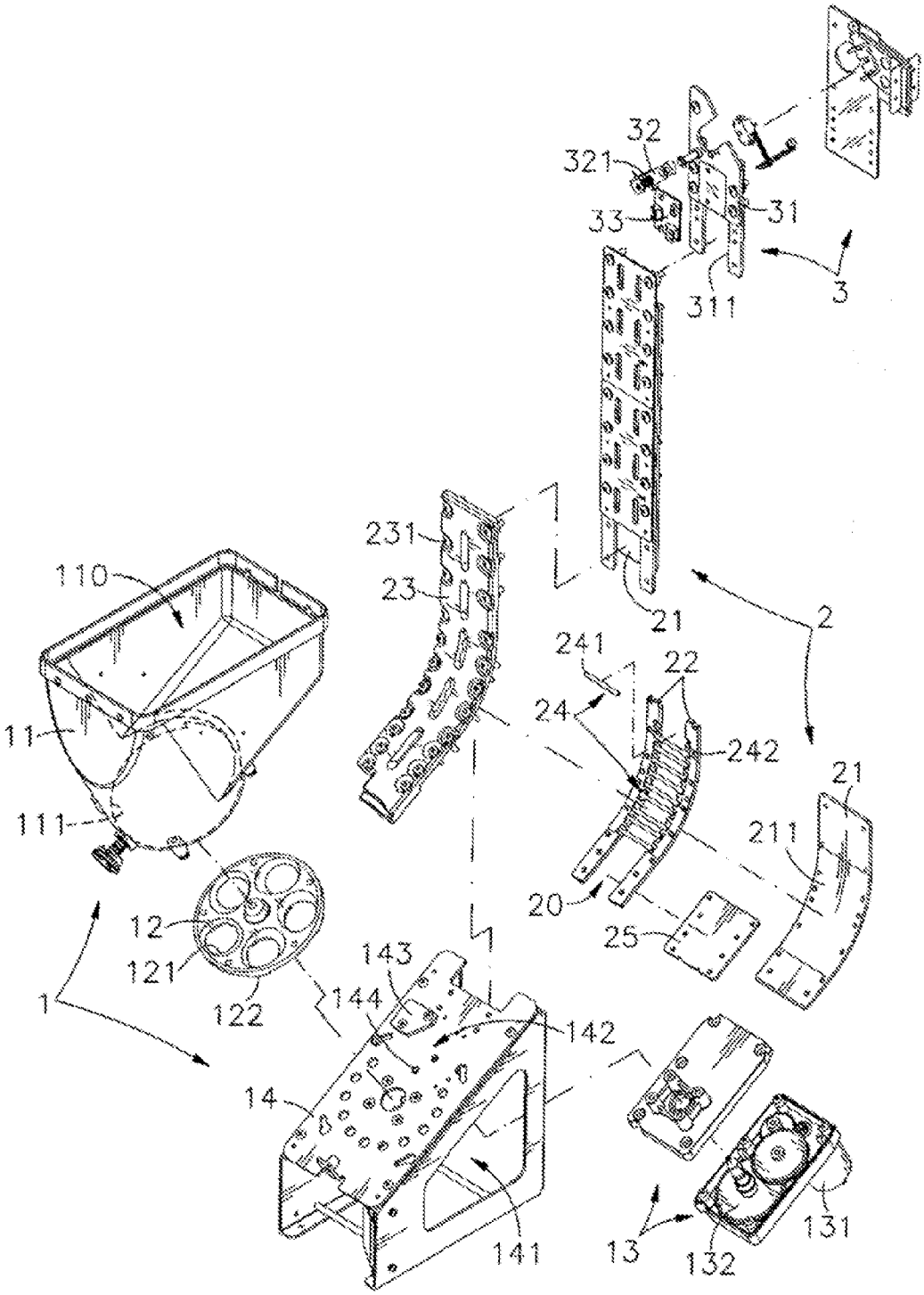
FIG. 2 is an exploded view of the coin hopper in accordance with the present invention.
Figure 3:
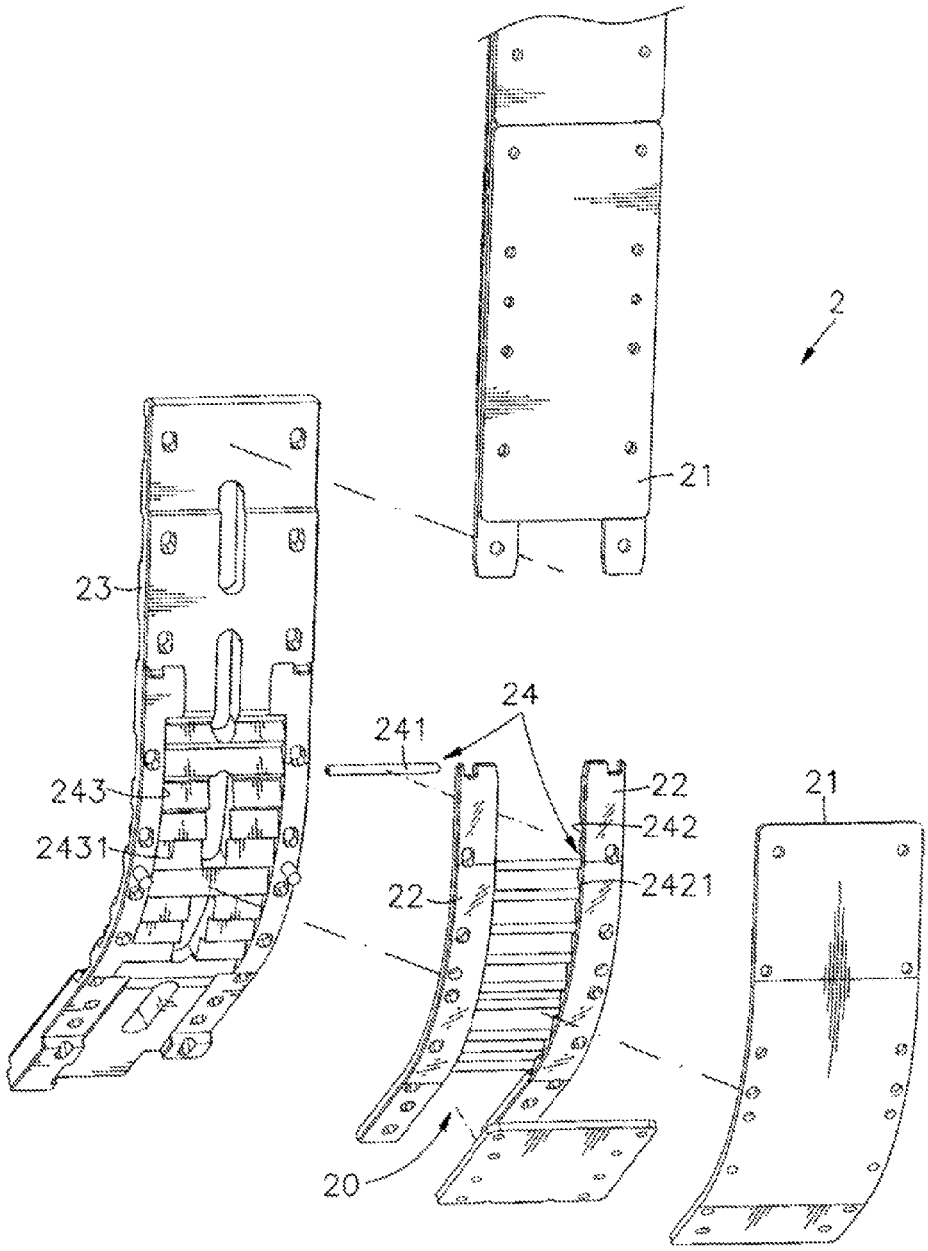
FIG. 3 is an exploded view of the track of the coin hopper in accordance with the present invention.

Referring to FIGS. 1, 2 and 3, a coin hopper for use in a coin dispenser in accordance with the present invention is shown. The coin hopper comprises a coin pusher 1, a track 2, and a coin ejector 3.

The coin pusher 1 comprises a container 11, a rotary disk 12, a power drive 13, and a rack 14. The container 11 defines a storage chamber 110 for storing coins in a bulk condition, and a bottom opening 111 downwardly extended from the storage chamber 110 and gradually contracted. The rotary disk 12 is disposed at the bottom side of the coin pusher 1, comprising a plurality of coin slots 121 and a push member 122. The rack 14 is disposed at the bottom side of the rotary disk 12, comprising a sloping coin path 142 disposed at the top side thereof, a coin guide 143 disposed in the sloping coin path 142, a plurality of stop rods 144 set in the sloping coin path 142, and an accommodation chamber 141 defined in the bottom side thereof. The power drive 13 is mounted in the accommodation chamber 141 of the rack 14, comprising a motor 131 and a transmission mechanism 132 coupled with the rotary disk 12 and drivable by the motor 131 to rotate the rotary disk 12.

Figure 4:
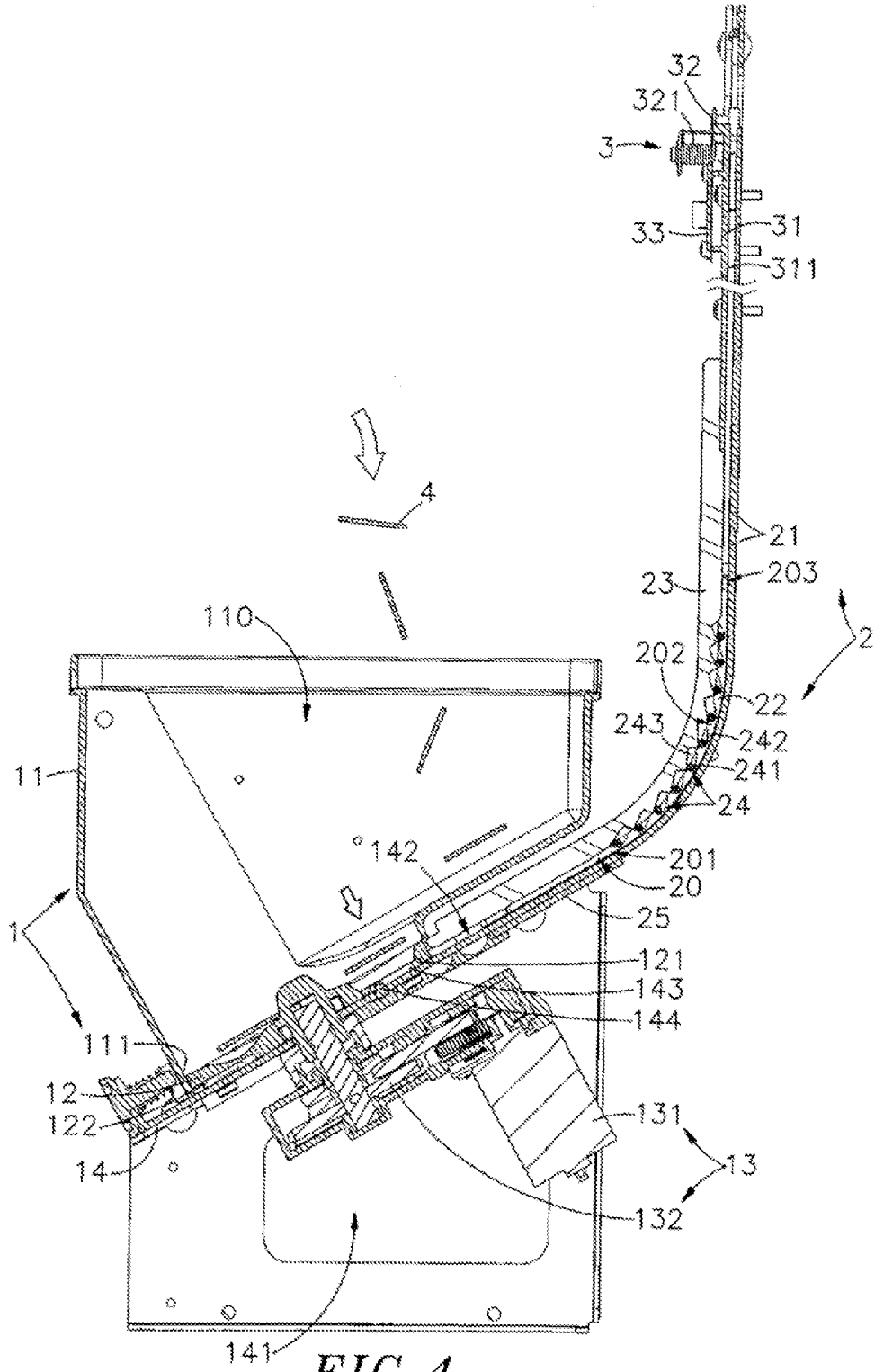
FIG. 4 is a sectional side view of the present invention, showing the status of the coin hopper before operation.
Figure 5:
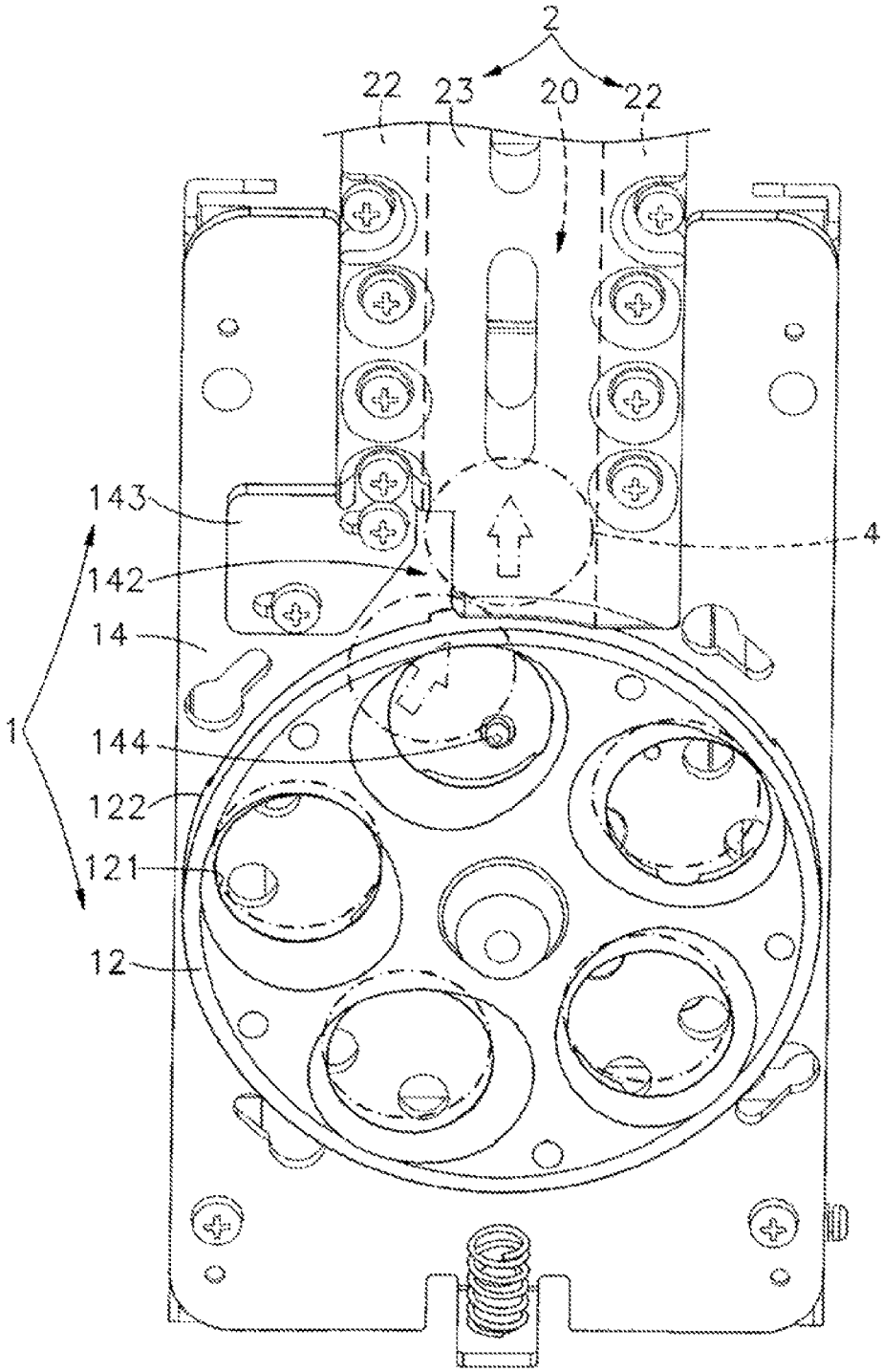
FIG. 5 is a schematic top view of the present invention, illustrating an operation status of the coin hopper.
Figure 6:
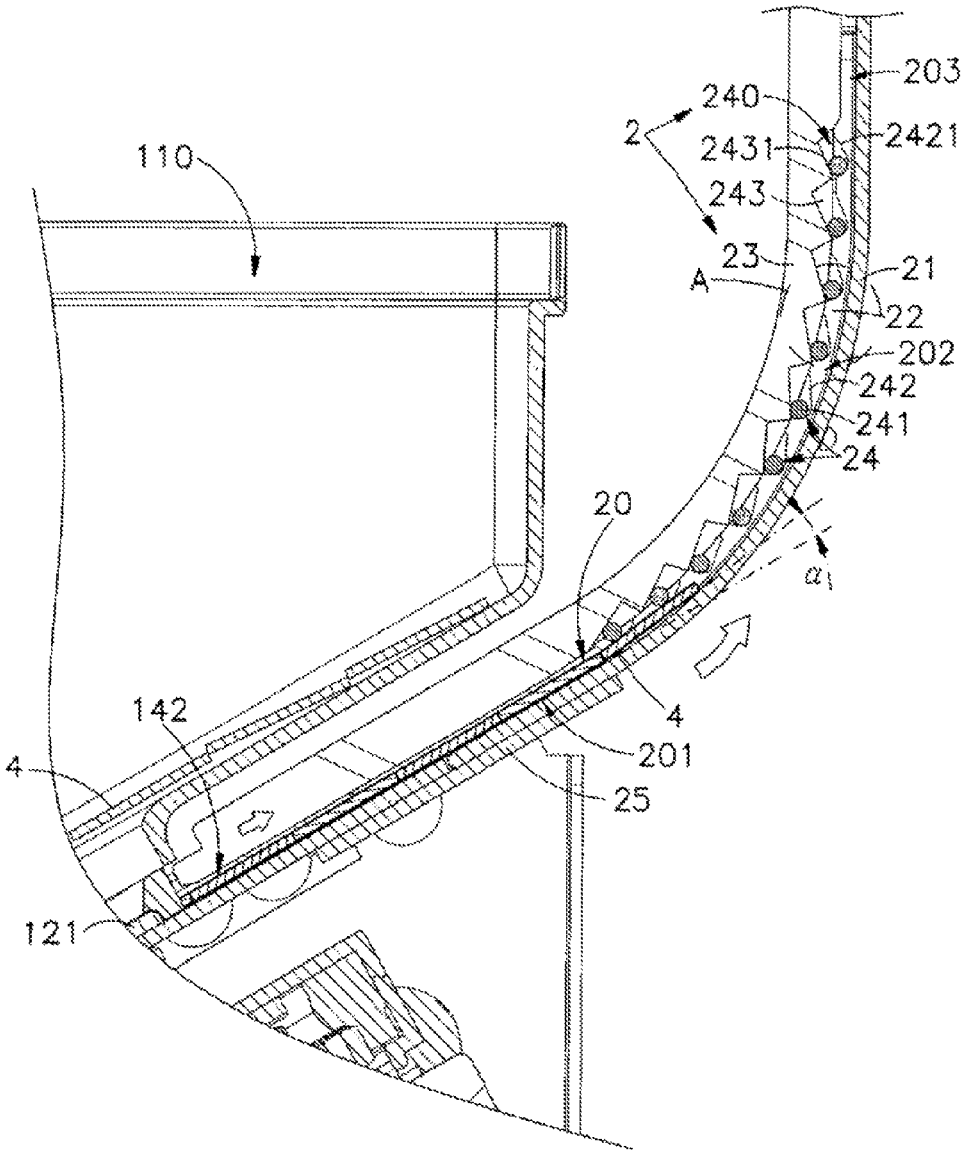
FIG. 6 is a schematic sectional side view of the present invention, illustrating an operation status of the coin hopper (I).

The track 2 defines therein a coin passage 20. As shown in FIG. 4, the coin passage 20 comprises a bottom sloping segment 201 connected to the sloping coin path 142 of the rack 14, a top vertical segment 203, and an intermediate arched segment 202 connected between the bottom sloping segment 201 and the top vertical segment 203. Further, the track 2 comprises a bottom plate 21 disposed at the bottom side of the coin passage 20, a cover plate 23 disposed at the top side of the coin passage 20, two side rails 22 disposed at two opposite lateral sides of the coin passage 20 and sandwiched between the bottom plate 21 and the cover plate 23, a plurality of fastening members 231 mounted in the cover plate 23 and driven into the side rails 22 and the bottom plate 21 to affix the cover plate 23, the side rails 22 and the bottom plate 21 together, and non-return means 24 arranged in the coin passage 20 between the side rails 22 and the cover plate 23 to restrict the movement of coins in one direction. The top surface 211 of the bottom plate 21 is configured to fit the bottom sloping segment 201, intermediate arched segment 202 and top vertical segment 203 of the coin passage 20. The non-return means 24 comprises a plurality of floating spaces 240 arranged in series in the coin passage 20 corresponding to the intermediate arched segment 202, and a floating rod 241 floating in each floating space 240. Each floating space 240 comprises two first constraint grooves 242 respectively located on the two side rails 22, and a second constraint groove 243 located on the cover plate 23 corresponding to the first constraint grooves 242. The first constraint grooves 242 and the second constraint groove 243 each have a bearing surface 2421 or 2431. The floating space 240 has a depth, which is the distance between the bearing surface 2431 of the second constraint groove 243 and the top surface 211 of the bottom plate 21 and reduces gradually in direction away from the coin passage 20. The bearing surface 2421 or 2431 can be a sloping surface or arched surface.

The coin ejector 3 is mounted at the top side of the track 2, comprising a guide plate 31 that defines a coin outlet 311 in communication with the coin passage 20, a coin-ejection plate 32 pivotally connected to the guide plate 31 and supported on a spring member 321 that is mounted at the guide plate 31, and a coin sensor 33 mounted at the guide plate 31 and adapted for sensing the presence of a coin 4 passing through the coin outlet 311.

During installation of the coin hopper, fixedly connect between the bottom plate 21 of the track 2 to the rack 14 of the coin pusher 1 by a mounting plate 25 to keep the coin passage 20 of the track 2 in alignment with the sloping coin path 142 of the rack 14, and then affix the coin ejector 3 to the top side of the track 2. Thereafter, fasten up the fastening members 231 to affix the cover plate 23, the side rails 22 and the bottom plate 21 together and also to affix the guide plate 31 to the side rails 22 and the cover plate 23, keeping the coin outlet 311 of the guide plate 31 of the coin ejector 3 in communication with the coin passage 20. At this time, the coin hopper is well assembled, and the track 2 curves upwardly and backwardly from the rack 14 to the guide plate 31.

As stated above, the track 2 is formed of the bottom plate 21, the side rails 22, the cover plate 23, the non-return means 24 and the mounting plate 25, defining therein the coin passage 20. Further, the bottom sloping segment 201, intermediate arched segment 202 and top vertical segment 203 of the coin passage 20 can be integrally made in a single piece. Alternatively, the bottom sloping segment 201, the intermediate arched segment 202 and the top vertical segment 203 can be separately made and then affixed together to constitute the coin passage 20.

Referring to FIGS. 4 through 8, the angular position of the coin guide 143 in the sloping coin path 142 of the rack 14 can be properly adjusted subject to the thickness and size of the coins 4 to be dispensed. After loading of coins 4 in the storage chamber 110 of the container 11, the motor 131 of the power drive 13 can be started to rotate the transmission mechanism 132 and the rotating disc 12, causing coins 4 to fall to the coin slots 121 in a proper order. When one coin 4 falls to one coin slot 121, the coin 4 will be pushed by the push member 122 of the rotating disc 12 to move along the coin guide 143 and the sloping coin path 142 toward the coin passage 20 of the track 2. Subject to the centrifugal force produced during rotation of the rotating disc 12, each fallen coin 4 will be thrown out of the sloping coin path 142 by the push member 122 into the coin passage 20 in the track 2. When one coin 4 enters the coin passage 20 and travels along the bottom sloping segment 201 to the intermediate arched segment 202, it will push the floating rods 241 upwards in the associating constraint grooves 242 and 243. Thus, the coin 4 can be moved upwards along the top surface 211 of the bottom plate 21 at the bottom side of the coin passage 20 at an angle "a". Because the bottom plate 21 is configured subject to curvature of the coin passage 20, the friction resistance between the coin 4 and the bottom plate 21 is low. Therefore, the coin 4 can be quickly moved to the top vertical segment 203 of the coin passage 20. Further, when one coin 4 is moved to the space between floating rods 241 of the non-turn means 24, the floating rods 241 will fall along the associating bearing surfaces 2431 and stopped at the front and rear sides of the top wall of the coin 4 to hold down the coin 4. At this time, subject to the effect of gravity and friction, the coin 4 is held down by the respective floating rods 241 at the associating bearing surfaces 2431. Thus, coins 4 can be moved upwards one by one in a proper order and are prohibited from backward movement or stacking, avoiding component damage or motor overload.

Figure 7:
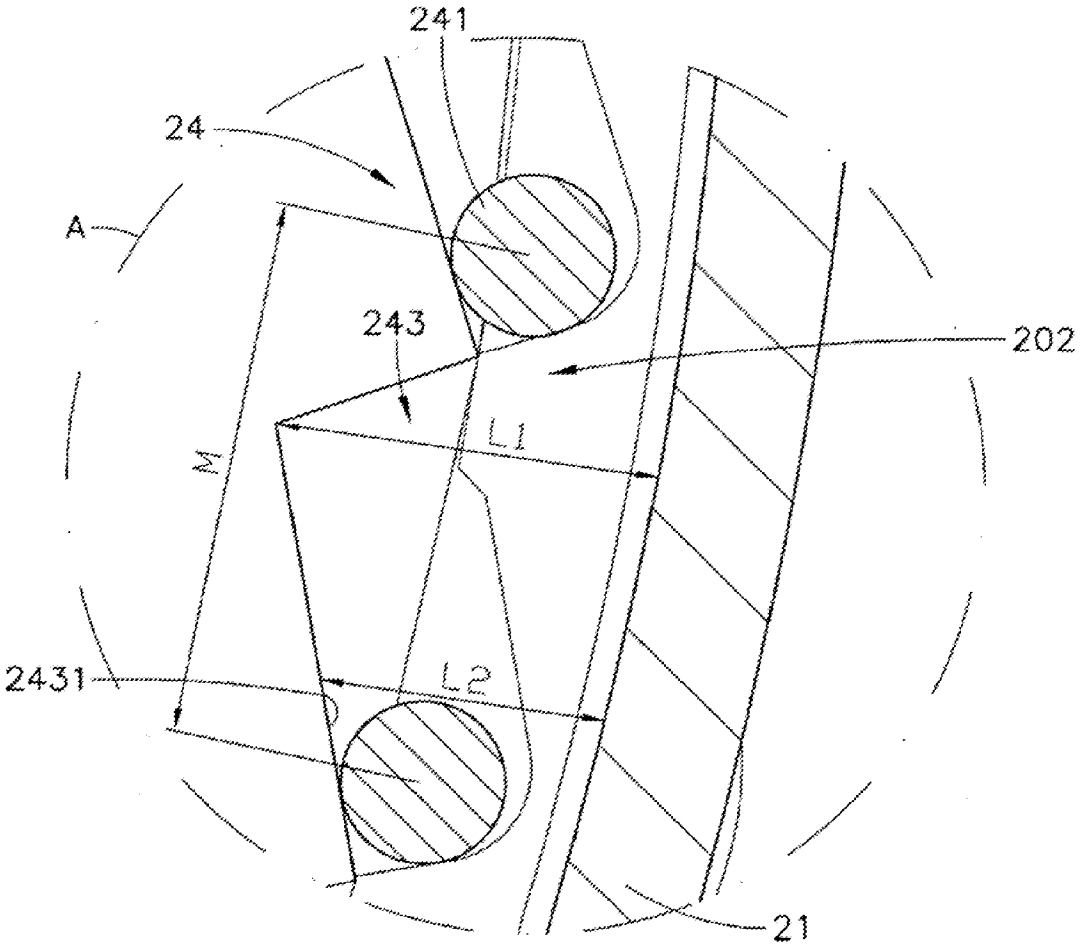
FIG. 7 is an enlarged view of the circle A shown in FIG. 6.
Figure 8:
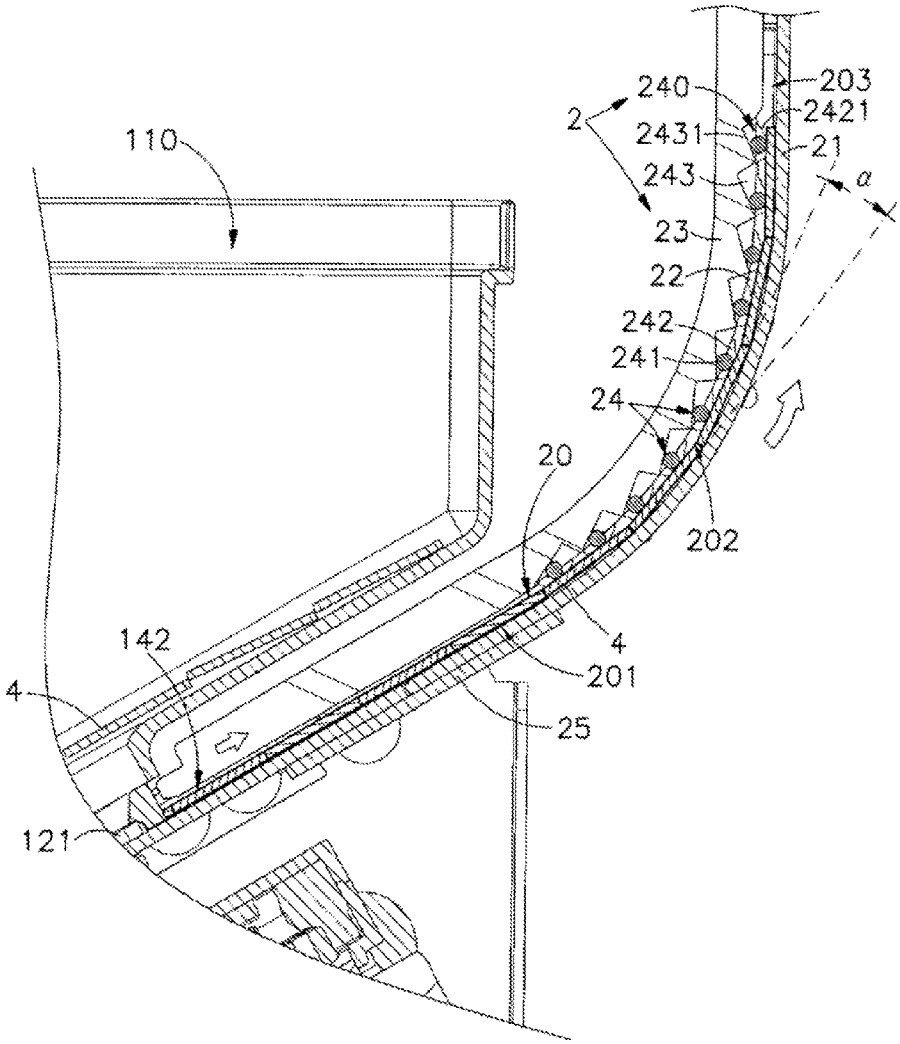
FIG. 8 is a schematic sectional side view of the present invention, showing an operation status of the coin hopper (II).
Figure 9:
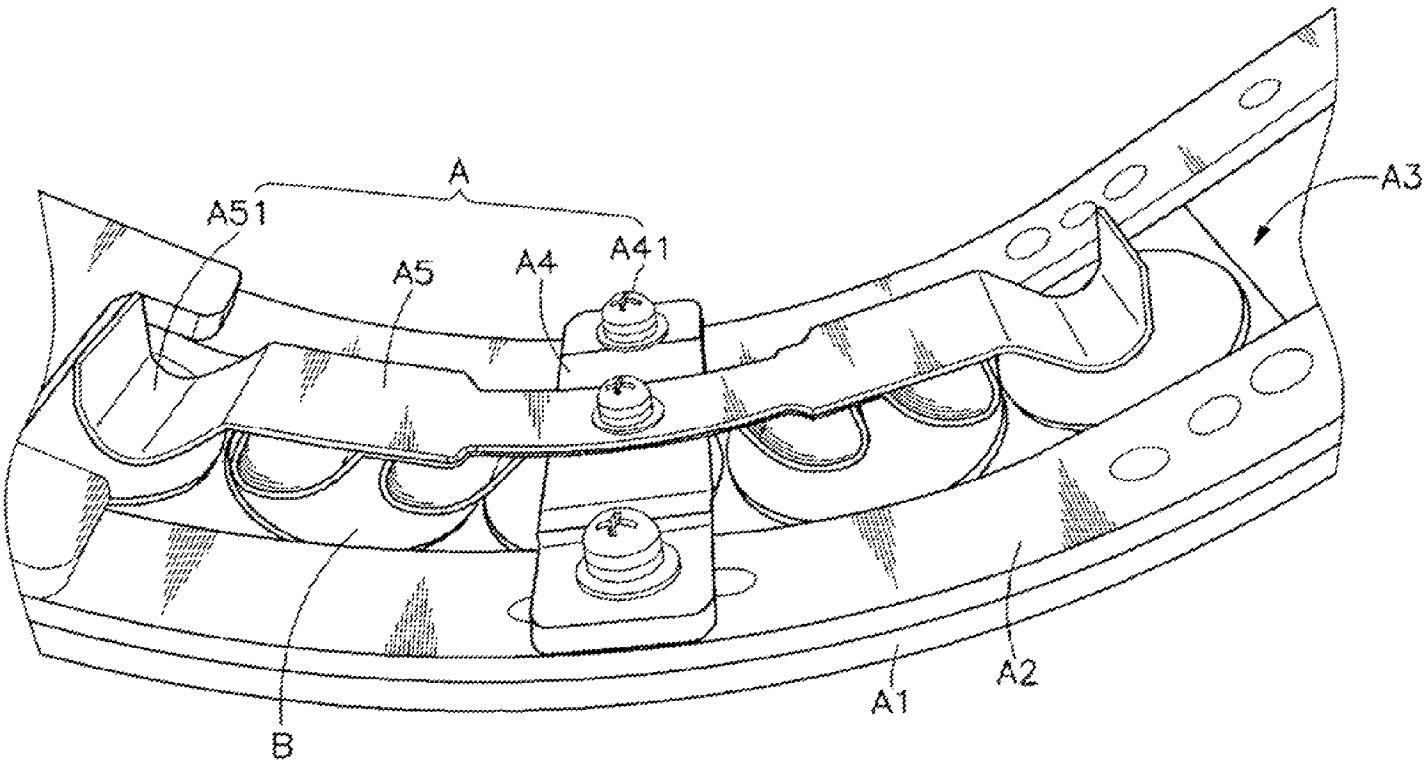
PRIOR ART FIG. 9
FIG. 9 illustrates a track for coin hopper according to the prior art.

Further, the coins 4 to be dispensed are metal elements that are not bendable. The arrangement of the intermediate arched segment 202 of the coin passage 20 between the bottom sloping segment 201 and the top vertical segment 203 enables coins 4 to be moved from the bottom sloping segment 201 to the top vertical segment 203 smoothly. However, when one coin 4 passes through the intermediate arched segment 202 toward the top vertical segment 203, it cannot be wholly kept in contact with the top surface 211 of the bottom plate 21. At this time, the coin 4 is kept at an angle "a" relative to the bottom plate 21, i.e., the top and bottom edges of the coin 4 are stopped against the bottom plate 21 and the middle part of the coin 4 is spaced from the top surface 211 of the bottom plate 21 at a distance. In the present invention, the depth of the floating space 240, which is the distance between the bearing surface 2431 of the second constraint groove 243 and the top surface 211 of the bottom plate 21, reduces gradually an upstream direction along the coin passage 20. As shown in FIG. 7, the depth L1 is larger than the depth L2. Thus, the intermediate arched segment 202 must provide a sufficient space for allowing coins 4 to pass. Also, according to the present invention, the floating rods 241 that do not touch the coins 4 will fall to the bottom ends of the constraint grooves 242;243 subject to the effect of their gravity. During delivery of the coins 4 through the coin passage 20, the floating rods 241 are moved upwards along the bearing surfaces 2431 of the constraint grooves 243 by the moving coins 4. As the top edges of the floating rods 241 are stopped at the bearing surfaces 2431 of the constraint grooves 243, each antecedent coin 4 that is pushed by a succeeding coin 4 is stopped by the respective floating rods 241 from tilting, avoiding coin stacking or jam. Thus, all the coins 4 can be delivered smoothly through the track 2 to the coin ejector 3, avoiding track parts damage or motor overload.

Further, when one coin 4 is being pushed upwardly along the coin passage 20 to the coin ejector 3, the coin 4 will bias the coin-ejection plate 32 to deform the spring member 321. When the coin 4 is being continuously pushed upwards and moved out of the coin passage 20, the spring member 321 immediately returns to its former shape to return the coin-ejection plate 32, causing the coin-ejection plate 32 to eject the coin 4 out of the coin outlet 311. At this time, the coin sensor 33 senses the dispensing of the coin 4.

The coin hopper with an upward coin passage in accordance with the present invention is characterized by the technical features as follows:

1. The non-return means 24 in the coin passage 20 of the track 2 has the characteristics of simple structure and ease of installation. By means of using the dispensing coins 4 to push the floating rods 241 of the non-return means 24 upwards, the force of the insertion of the dispensing coins 4 into the coin passage 20 is low. After insertion of one coin 4 into the coin passage 20, the effect of the gravity of the coin 4 causes the respective floating rods 241 to move downwards to the ends of the bearing surfaces 2431 of the respective constraint grooves 243, avoiding back movement of the dispensed coin 4. Therefore, the coin hopper of the present invention has characteristics of low failure rate and coin non-return function and fits different sizes of coins.

2. The design of the non-return means 24 allows coins 4 to push the floating rods 241 upwards in the associating constraint grooves 242 and 243 so that coin 4 can be moved upwards along the bottom sloping segment 201, intermediate arched segment 202 and top vertical segment 203 of the coin passage 20 smoothly at a predetermined sloping angle with less friction. Thus, the motor 131 can smoothly rotate the rotating disc 12 to accurately dispense coins 4. Therefore, it is not necessary to upgrade the capacity of the motor 131 or to enhance the structural strength of the track 2, saving the cost.

3. When one coin 4 is inserted into the coin passage 20 between the floating rods 241 of the non-return means 24, the respective floating rods 241 are caused by the coin 4 to move downward along the bearing surfaces 2431 of the respective constraint grooves 243 from the relatively wider side toward the relatively narrower side to stop the coin 4 from backward displacement. Thus, when the coins 4 enter the coin passage 20, they can be moved upwards one by one in a proper order and are prohibited from stacking. Therefore, the invention prevents track parts damage or motor overload.

4. The first constraint grooves 242 and the second constraint groove 243 each have a bearing surface 2421 or 2431. The floating space 240 has a depth, which is the distance between the bearing surface 2431 of the second constraint groove 243 and the top surface 211 of the bottom plate 21 and reduces gradually in direction away from the coin passage 20. In other words, the depth L1 is larger than the depth L2. Thus, the intermediate arched segment 202 of the coin passage provide a sufficient space for allowing coins 4 to pass, avoiding coin stacking and preventing track parts damage or motor overload.

Although a particular embodiment of the invention has been described in detail for purposes of illustration, various modifications and enhancements may be made without departing from the spirit and scope of the invention. For example, the size of the coin passage 20 may vary with the size of the coins 4 to be dispensed. The coins 4 to be dispensed can be any of a variety of shapes (such as circular shape, polygonal shape, etc.) and sizes. Preferably, the coin hopper is adapted to dispense coins 4 of thickness within 1.6~2.3 mm and diameter within 21~26 mm. Further, the pitch M (as shown in FIG. 7) between two adjacent floating rods 241 of the non-return means 24 in the coin passage 20 is preferably about 10 mm. The design of the non-return means 24 enables the dispensing coins 4 to be inserted into the coin passage 20 and moved from the bottom sloping segment 201 to the top vertical segment 203 through the intermediate arched segment 202 at a predetermined sloping angle "α" so that the floating rods 241 of the non-return means 24 can be moved upwards by the dispensing coins 4 and then lowered to the ends of the bearing surfaces 2431 of the respective constraint grooves 243 to stop the dispensing coins 4 from backward movement or stacking. Accordingly, the invention is not to be limited except as by the appended claims.

It is to be understood that the above-described embodiment of the invention is merely a possible example of implementations, merely set forth for a clear understanding of the principles of the invention, many modifications and enhancements may be made without departing from the spirit and scope of the invention. Accordingly, the invention is not to be limited except as by the appended claims.

What the invention claimed is:

1. A coin hopper for dispensing coins, comprising:

a coin pusher, said coin pusher comprising a container having a bottom opening, a coin outlet, a rotating disc mounted in said container and a power drive adapted for rotating said rotating disc to dispense coins out of said bottom opening of said container through said coin outlet; and a track connected to said coin pusher, said track comprising a coin passage, a bottom plate disposed at a bottom side of said coin passage, a cover plate disposed at a top side of said coin passage, two side rails disposed at two opposite lateral sides of said coin passage and sandwiched between said bottom plate and said cover plate, and non-return means arranged in said coin passage to restrict the movement of coins in one direction, said coin passage comprising a bottom sloping segment connected to said coin outlet, a top vertical segment and an intermediate arched segment connected between said bottom sloping segment and said top vertical segment, said non-return means comprising a plurality of floating spaces arranged in series in said coin passage corresponding to said intermediate arched segment and a floating rod floating in each said floating space, each said floating space comprising two first constraint grooves respectively located on said two side rails, and a second constraint groove located on said cover plate corresponding to said first constraint grooves.

2. The coin hopper as claimed in claim 1, wherein said coin pusher further comprises a rack disposed at a bottom side of said rotary disc; said rotating disc comprises a plurality of coin slots equiangularly arranged around the center thereof for dispensing coins and a push member protruded from the periphery thereof for pushing dispensed coins out of said bottom opening of said container; said power drive comprises a motor mounted inside said rack and a transmission mechanism coupled between said motor and said rotating disc and rotatable by said motor to rotate said rotating disc.

3. The coin hopper as claimed in claim 2, wherein said rack comprises a sloping coin path disposed at a top side thereof between said bottom opening of said container and said rack, a coin guide disposed in said sloping coin path, a plurality of stop rods set in said sloping coin path and an accommodation chamber defined in a bottom side thereof.

4. The coin hopper as claimed in claim 1, wherein said first constraint grooves and said second constraint groove each have a bearing surface, and the floating space has a depth which is a distance between the bearing surface of the second constraint groove and a top surface of the bottom plate and reduces gradually in an upstream direction along said coin passage.

5. The coin hopper as claimed in claim 4, wherein said bearing surface is a sloping surface or arched surface.

6. The coin hopper as claimed in claim 4, wherein the pitch between each two adjacent floating rods of said non-return means in said coin passage is about 10 mm.

7. The coin hopper as claimed in claim 1, wherein said track further comprises a plurality of fastening members mounted in said cover plate and driven into said side rails and said bottom plate to affix said cover plate, said side rails and said bottom plate together.

8. The coin hopper as claimed in claim 1, further comprising a coin ejector mounted at a top side of said track, said coin ejector comprising a guide plate that defines a coin outlet in communication with said coin passage, a spring member mounted at said guide plate, and a coin-ejection plate pivotally connected to said guide plate and supported on said spring member.

9. The coin hopper as claimed in claim 8, wherein said coin ejector further comprises a coin sensor mounted at said guide plate and adapted for sensing the presence of a coin passing through the coin outlet of said guide plate.

* * * * *